US011753132B1

(12) United States Patent
Nakayasu

(10) Patent No.: US 11,753,132 B1
(45) Date of Patent: Sep. 12, 2023

(54) SYSTEM AND METHOD FOR CONTROLLING PROPULSION DEVICE MOUNTED ON WATERCRAFT

(71) Applicant: YAMAHA HATSUDOKI KABUSHIKI KAISHA, Iwata (JP)

(72) Inventor: Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 532 days.

(21) Appl. No.: 17/066,567

(22) Filed: Oct. 9, 2020

Related U.S. Application Data

(60) Provisional application No. 62/954,036, filed on Dec. 27, 2019.

(51) Int. Cl.
*B63H 25/02* (2006.01)

(52) U.S. Cl.
CPC ..... *B63H 25/02* (2013.01); *B63H 2025/026* (2013.01)

(58) Field of Classification Search
CPC ..... B63H 25/02; B63H 2025/026
See application file for complete search history.

(56) References Cited

U.S. PATENT DOCUMENTS

| | | | | |
|---|---|---|---|---|
| 10,766,589 | B1 * | 9/2020 | Ito | G05D 1/0206 |
| 11,014,638 | B1 * | 5/2021 | Davis | B63B 1/16 |
| 2015/0166159 | A1 * | 6/2015 | Inoue | B63H 20/12 440/53 |
| 2021/0354803 | A1 * | 11/2021 | Christensen | B60L 53/20 |
| 2023/0049367 | A1 * | 2/2023 | Endrizzi | B63H 25/42 |

FOREIGN PATENT DOCUMENTS

JP 2008-155764 A 7/2008

* cited by examiner

*Primary Examiner* — Richard M Camby
(74) *Attorney, Agent, or Firm* — KEATING AND BENNETT, LLP

(57) ABSTRACT

A controller controls a shift operation of a propulsion device between forward, neutral, and reverse, and steering of the propulsion device in accordance with a tilt operation of a joystick. The controller stores a control state of the propulsion device according to the tilt operation of the joystick when a switch is operated. The controller maintains the propulsion device in the control state even when the joystick is returned to the neutral position.

20 Claims, 12 Drawing Sheets

SYSTEM AND METHOD FOR CONTROLLING PROPULSION DEVICE MOUNTED ON WATERCRAFT

CROSS REFERENCE TO RELATED APPLICATIONS

This application claims the benefit of priority to U.S. Provisional Patent Application No. 62/954,036 filed on Dec. 27, 2019. The entire contents of this application are hereby incorporated herein by reference.

BACKGROUND OF THE INVENTION

1. Field of the Invention

The present invention relates to a system and a method for controlling a propulsion device mounted on a watercraft.

2. Description of the Related Art

Some systems for controlling a propulsion device include a joystick. For example, as shown in Japan Laid-open Patent Application Publication No. 2008-155764, the joystick is tiltable in the front-rear direction and the left-right direction from the neutral position. The controller of the system receives a signal indicative of the operation of the joystick. The controller controls the propulsion device so that the watercraft moves back and forth according to the tilt operation of the joystick in the front-rear direction. The controller controls the propulsion device so that the watercraft moves left and right in accordance with the tilt operation of the joystick in the left-right direction.

In the above system, when the operator releases the joystick, the joystick returns to the neutral position. As a result, the shift state of the propulsion device returns to neutral, and the steering angle of the propulsion device returns to the predetermined angle. Therefore, in order to maintain the propulsion device in the desired control state, the operator has to hold the joystick in a position corresponding to that control state.

SUMMARY OF THE INVENTION

Preferred embodiments of the present invention reduce burdens of an operator operating a joystick of a propulsion device control system.

A system according to a preferred embodiment of the present disclosure controls a propulsion device mounted to a watercraft. The system includes a joystick, a switch, and a controller. The joystick is tiltable at least in a front-rear direction and a left-right direction from a neutral position. The controller is in communication with the joystick and the switch. The controller controls a shift operation of the propulsion device between forward, neutral, and reverse, and the steering of the propulsion device in accordance with the tilt operation of the joystick. The controller stores a control state of the propulsion device according to the tilt operation of the joystick when the switch is operated. The controller maintains the propulsion device in the control state even when the joystick is returned to the neutral position. The controller may release the propulsion device from the control state by operating the joystick again. Alternatively, the controller may release the propulsion device from the control state by operating a release switch.

A method according to a preferred embodiment of the present disclosure includes controlling a propulsion device mounted on a watercraft. The method includes the following processes. A first process includes receiving a signal from a joystick that is tiltable in at least a front-rear direction and a left-right direction from a neutral position. A second process includes controlling a shift operation of the propulsion device between forward and backward, and steering the propulsion device according to the tilt operation of the joystick in the front-rear direction. A third process includes receiving a signal from the switch. A fourth process includes storing a control state of the propulsion device according to the tilt operation of the joystick when the switch is operated. A fifth process includes maintaining the propulsion device in the control state even when the joystick is returned to the neutral position. The order of execution of the processes is not limited to the above order and may be changed.

The above and other elements, features, steps, characteristics and advantages of the present invention will become more apparent from the following detailed description of the preferred embodiments with reference to the attached drawings.

DETAILED DESCRIPTION OF THE REFERRED EMBODIMENTS

Figure 1:
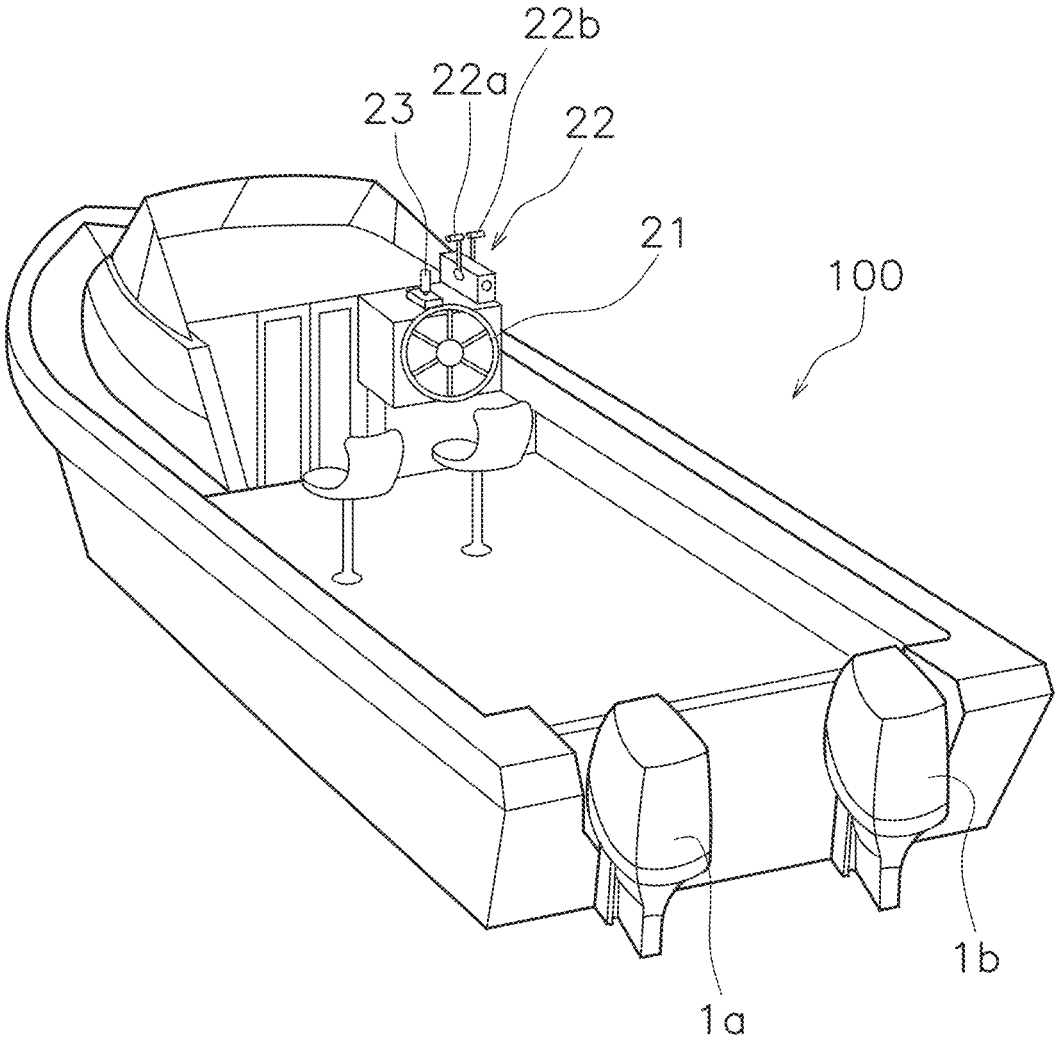
FIG. 1 is a perspective view showing a watercraft equipped with a system according to a preferred embodiment of the present invention.

Hereinafter, preferred embodiments of the present invention will be described with reference to the drawings. FIG. 1 is a perspective view showing a watercraft 100 equipped with a system according to a preferred embodiment of the present invention. The watercraft 100 includes a plurality of propulsion devices 1*a* and 1*b*. The propulsion devices 1*a* and 1*b* are, for example, outboard motors. Specifically, the watercraft 100 includes a left propulsion device 1*a* and a right propulsion device 1*b*.

The propulsion devices 1*a* and 1*b* are attached to a stern of the watercraft 100. The propulsion devices 1*a* and 1*b* are arranged side by side in a left-right direction of the watercraft 100. Specifically, the left propulsion device 1*a* is located on a port side of the watercraft 100. The right propulsion device 1*b* is located on a starboard side of the watercraft 100. The propulsion devices 1*a* and 1*b* each generate a thrust to propel the watercraft 100.

Figure 2:
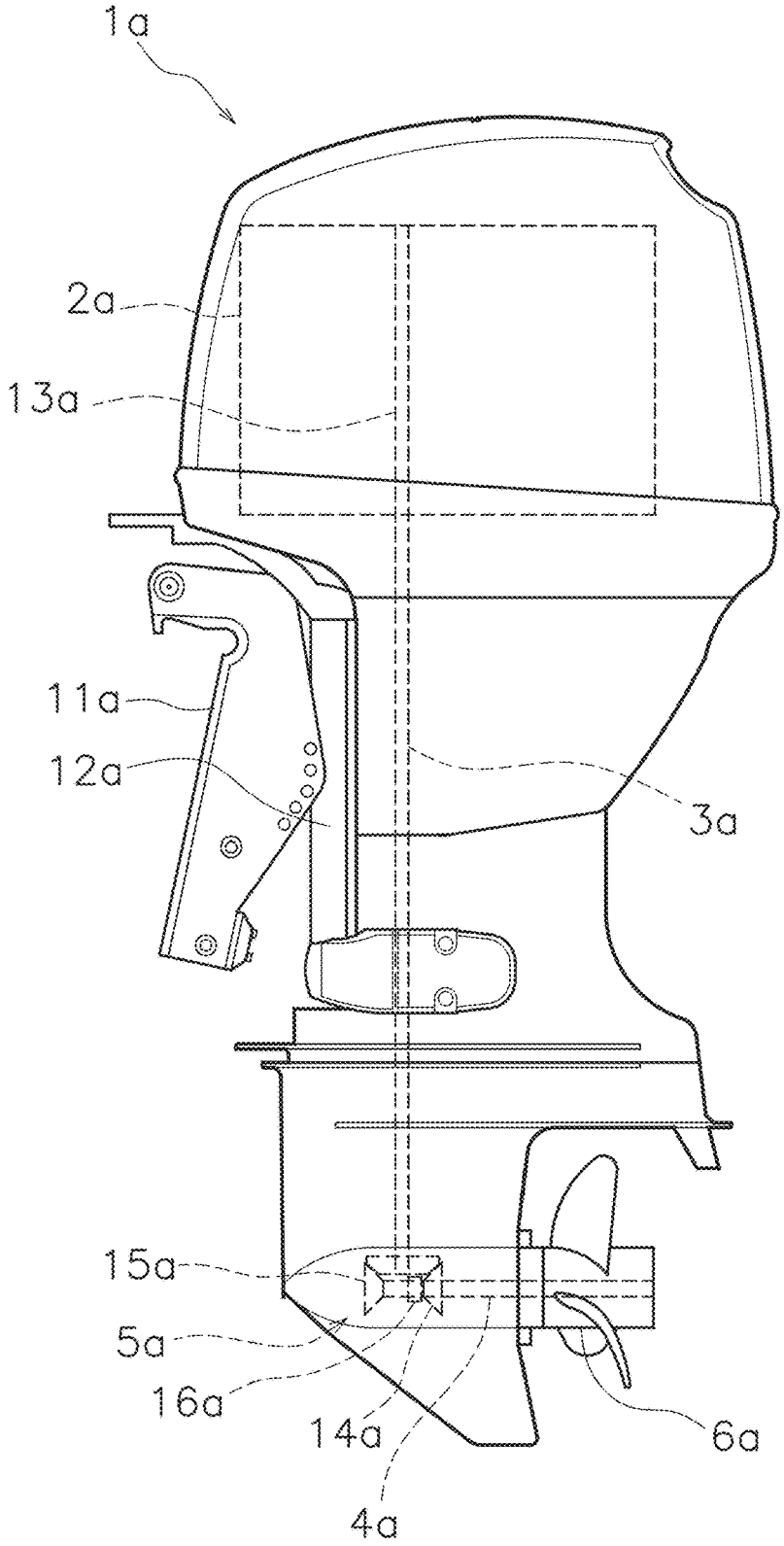
FIG. 2 is a side view of a propulsion device.

FIG. 2 is a side view of the left propulsion device 1*a*. A structure of the left propulsion device 1*a* will be described below, but the right propulsion device 1*b* has the same structure as the left propulsion device 1*a*. The left propulsion device 1*a* is attached to the watercraft 100 via a bracket 11*a*. The bracket 11*a* rotatably supports the left propulsion device 1*a* around a steering shaft 12*a*. The steering shaft 12*a* extends in a vertical direction of the propulsion device 1*a*.

The left propulsion device 1*a* includes an engine 2*a*, a drive shaft 3*a*, a propeller shaft 4*a*, and a shift mechanism 5*a*. The engine 2*a* generates a thrust to propel the watercraft 100. The engine 2*a* includes a crankshaft 13*a*. The crankshaft 13*a* extends in the vertical direction of the propulsion device 1*a*. The drive shaft 3*a* is connected to the crankshaft 13*a*. The drive shaft 3*a* extends in the vertical direction of the propulsion device 1*a*. The propeller shaft 4*a* extends in the front-rear direction of the propulsion device 1*a*. The propeller shaft 4*a* is connected to the drive shaft 3*a* via a shift mechanism 5*a*. A propeller 6*a* is attached to the propeller shaft 4*a*.

The shift mechanism 5*a* includes a forward gear 14*a*, a reverse gear 15*a*, and a dog clutch 16*a*. By switching the connection of the gears 14*a* and 15*a* with the dog clutch 16*a*, the transmission direction of the rotation from the drive shaft 3*a* to the propeller shaft 4*a* is switched. As a result, the watercraft 100 is switched between forward and reverse.

Figure 3:
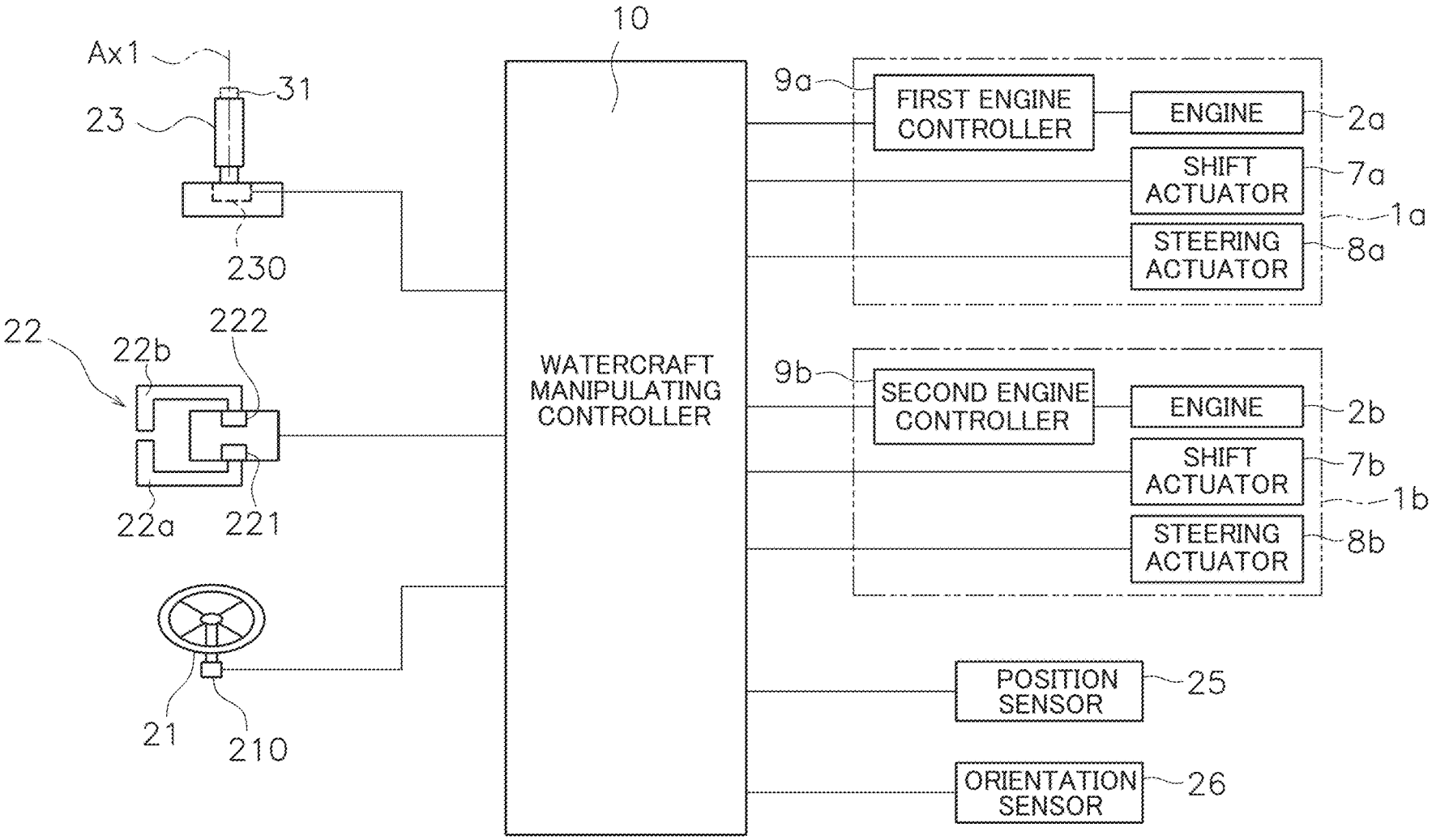
FIG. 3 is a block diagram showing a configuration of the system.

FIG. 3 is a schematic diagram showing a configuration of the system of the watercraft 100. As illustrated in FIG. 3, the left propulsion device 1*a* includes a shift actuator 7*a* and a steering actuator 8*a*.

The shift actuator 7*a* is connected to the dog clutch 16*a* of the shift mechanism 5*a*. The shift actuator 7*a* switches the connection between the gears 14*a* and 15*a* by operating the dog clutch 16*a*. As a result, the watercraft 100 is switched between forward and reverse. The shift actuator 7*a* includes, for example, an electric motor. However, the shift actuator 7*a* may be another type of actuator such as an electric cylinder, a hydraulic motor, or a hydraulic cylinder.

The steering actuator 8*a* is connected to the left propulsion device 1*a*. The steering actuator 8*a* rotates the left propulsion device 1*a* around the steering shaft 12*a*. As a result, the steering angle of the left propulsion device 1*a* is changed. The steering angle is an angle of the propeller shaft 4*a* with respect to the front-rear direction of the left propulsion device 1*a*. The steering actuator 8*a* includes, for example, an electric motor. However, the steering actuator 8*a* may be another type of actuator such as an electric cylinder, a hydraulic motor, or a hydraulic cylinder.

The left propulsion device 1*a* includes a first engine controller 9*a*. The first engine controller 9*a* includes a processor such as a CPU and a memory such as a RAM or a ROM. The first engine controller 9*a* stores a program and data to control the left propulsion device 1*a*. The first engine controller 9*a* controls the engine 2*a*.

Figure 4:
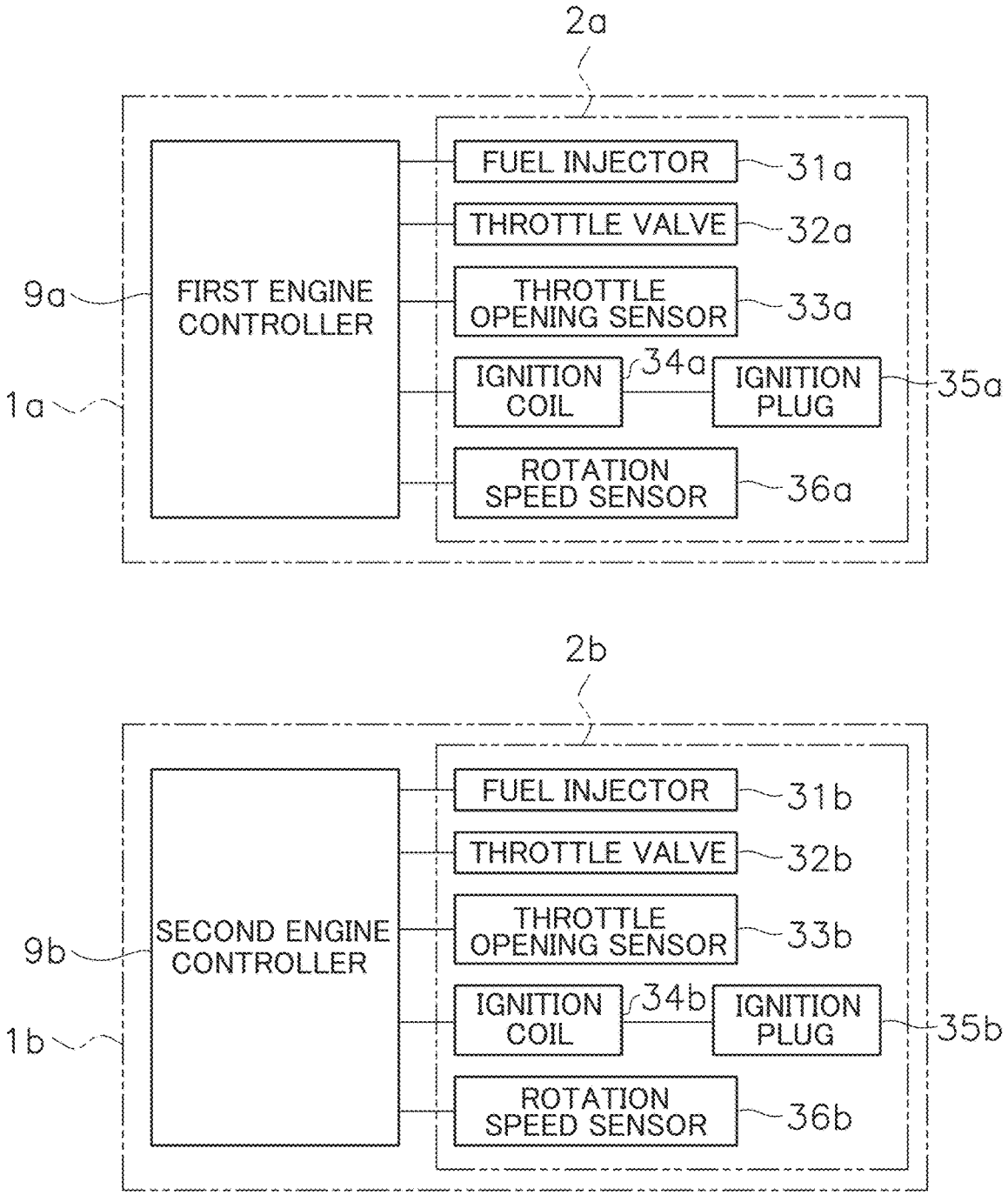
FIG. 4 is a block diagram showing a control system of an engine.

FIG. 4 is a block diagram showing a control system of the engine 2*a*. As illustrated in FIG. 4, the engine 2*a* includes a fuel injector 31*a*, a throttle valve 32*a*, and a throttle opening sensor 33*a*. The fuel injector 31*a* injects fuel into a combustion chamber of the engine 2*a*. The first engine controller 9*a* is communicatively connected to the fuel injector 31*a*. The first engine controller 9*a* controls the fuel injector 31*a* by outputting a command signal to the fuel injector 31*a*.

The throttle valve 32*a* opens and closes an intake passage of the engine 2*a*. The throttle opening sensor 33*a* outputs a signal indicative of an opening of the throttle valve 32*a*. The throttle valve 32*a* and the throttle opening sensor 33*a* are communicatively connected to the first engine controller 9*a*. The first engine controller 9*a* outputs a command signal to the throttle valve 32*a* to control the opening of the throttle valve 32*a*.

The engine 2*a* includes an ignition coil 34*a*, an ignition plug 35*a*, and a rotation speed sensor 36*a*. The ignition coil 34*a* supplies electric power to the ignition plug 35*a*. The ignition plug 35*a* generates an electric spark in the combustion chamber of the engine 2*a* to ignite the air-fuel mixture in the combustion chamber. The ignition coil 34*a* is communicatively connected to the first engine controller 9*a*. The first engine controller 9*a* controls the ignition coil 34*a* to control the ignition timing of the ignition plug 35*a* at a predetermined timing.

The rotation speed sensor 36*a* detects the engine speed. The rotation speed sensor 36*a* generates a pulse signal according to the rotation of the crankshaft 13*a* of the engine 2*a*, for example. The first engine controller 9*a* receives the signal from the rotation speed sensor 36*a*. The first engine controller 9*a* calculates engine speed based on the signal from the rotation speed sensor 36*a*.

As illustrated in FIG. 3, the right propulsion device 1*b* includes an engine 2*b*, a shift actuator 7*b*, a steering actuator 8*b*, and a second engine controller 9*b*. The engine 2*b*, the shift actuator 7*b*, the steering actuator 8*b*, and the second engine controller 9*b* of the right propulsion device 1*b* have the same configuration as the engine 2*a*, the shift actuator 7*a*, the steering actuator 8*a*, and the first engine controller 9*a* of the left propulsion device 1*a*, respectively.

As illustrated in FIG. 4, the engine 2*b* includes a fuel injector 31*b*, a throttle valve 32*b*, a throttle opening sensor 33*b*, an ignition coil 34*b*, an ignition plug 35*b*, and a rotation speed sensor 36*b*. The fuel injector 31*b*, the throttle valve 32*b*, the throttle opening sensor 33*b*, the ignition coil 34*b*, the ignition plug 35*b*, and the rotation speed sensor 36*b* of the engine 2*b* have the same configuration as the fuel injector 31*a*, the throttle valve 32*a*, the throttle opening sensor 33*a*, the ignition coil 34*a*, the ignition plug 35*a*, and the rotation speed sensor 36*a* of the engine 2*a*, respectively.

As illustrated in FIG. 3, the system includes a steering wheel 21, a remote controller 22, and a joystick 23. As illustrated in FIG. 1, the steering wheel 21, the remote controller 22, and the joystick 23 are located near an operator seat of the watercraft 100.

The steering wheel 21 allows an operator to control the turning direction of the watercraft 100. The steering wheel 21 includes a sensor 210. The sensor 210 outputs a steering signal indicative of an operation direction and an operation amount of the steering wheel 21.

The remote controller 22 includes a first throttle lever 22*a* and a second throttle lever 22*b*. The first throttle lever 22*a* allows the operator to adjust a magnitude of thrust of the left propulsion device 1*a*. The first throttle lever 22*a* allows the operator to switch a thrust direction of the left propulsion device 1*a* between forward and reverse. The first throttle lever 22*a* is operable in a forward direction and a backward direction from a neutral position. The neutral position is a position located between the forward direction and the reverse direction. The first throttle lever 22*a* includes a sensor 221. The sensor 221 outputs a throttle signal indicative of an operation direction and an operation amount of the first throttle lever 22*a*.

The second throttle lever 22*b* allows the operator to adjust a magnitude of thrust of the right propulsion device 1*b*. The second throttle lever 22*b* allows the operator to switch a thrust direction of the right propulsion device 1*b* between forward and reverse. The configuration of the second throttle lever 22*b* is similar to that of the first throttle lever 22*a*. The second throttle lever 22*b* includes a sensor 222. The sensor 222 outputs a throttle signal indicative of an operation direction and an operation amount of the second throttle lever 22*b*.

The joystick 23 allows the operator to control the moving direction of the watercraft 100 in the front, rear, left, and right directions. The joystick 23 also allows the operator to control a pivoting action of the watercraft 100.

Figure 5:
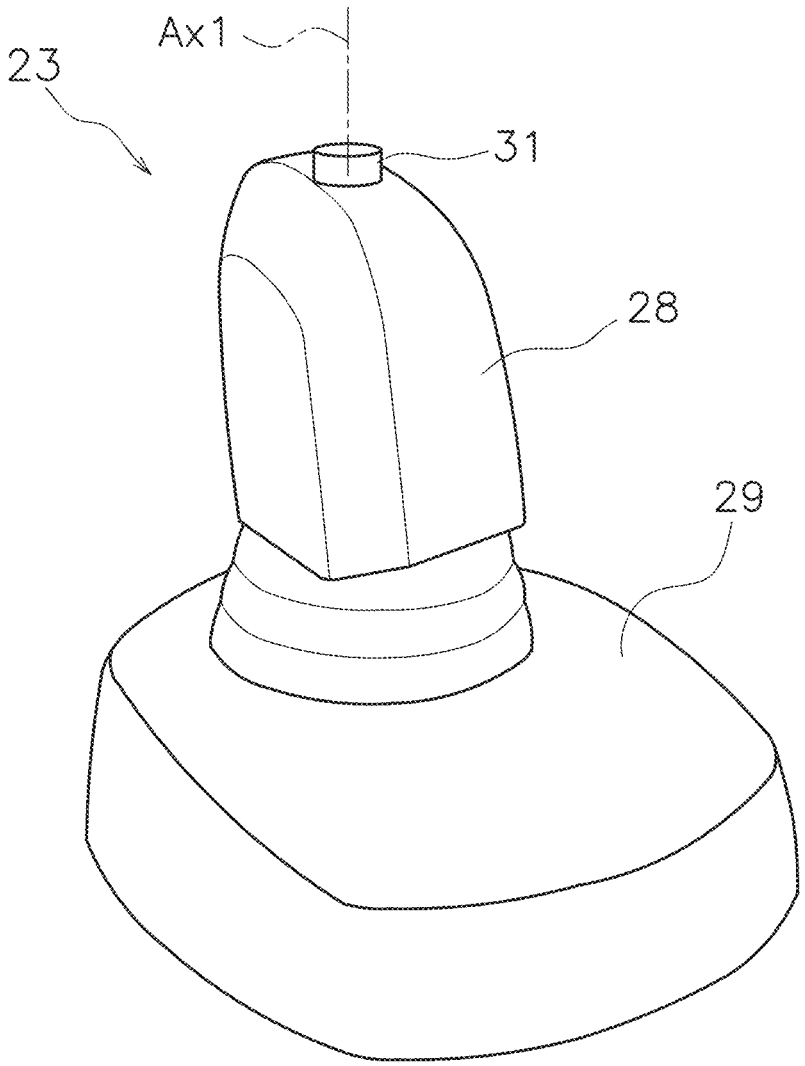
FIG. 5 is a perspective view of a joystick.

FIG. 5 is a perspective view of the joystick 23. As illustrated in FIG. 5, the joystick 23 includes a grip 28 and a base 29. The grip 28 extends upward from the base 29. The base 29 supports the grip 28 in a tiltable manner. From the neutral position, the grip 28 is tiltable in at least four directions of front, rear, left, and right. The grip 28 may be operable in four or more directions, or may be operable in all directions. The grip 28 is biased toward the neutral position by a spring (not illustrated). Therefore, when the operator does not tilt the grip 28, the grip 28 returns to the neutral position.

The grip 28 is supported by the base 29 so as to be rotatable around a rotation axis Ax1. That is, the grip 28 is twistable clockwise and counterclockwise from the central position about the rotation axis Ax1. The grip 28 is biased toward the central position by a spring (not illustrated). Therefore, when the operator is not twisting the grip 28, the grip 28 returns to the central position.

As illustrated in FIG. 2, the joystick 23 includes a sensor 230. The sensor 230 outputs a joystick signal indicative of an operation of the joystick 23. The joystick signal includes a tilt direction and a tilt amount of the grip 28. The joystick signal includes a twist direction and a twist amount of the grip 28. In the following description, the tilt direction, tilt amount, twist direction, and twist amount of the joystick 23 refer to the tilt direction, tilt amount, twist direction, and twist amount of the grip 28, respectively.

The system includes a watercraft manipulating controller 10. The watercraft manipulating controller 10 includes a processor such as a CPU and a memory such as a RAM or a ROM. The watercraft manipulating controller 10 stores a program and data to control the left propulsion device 1*a* and the right propulsion device 1*b*. The watercraft manipulating controller 10 is connected to the first and second engine controllers 9*a* and 9*b* by wire or wirelessly. The watercraft manipulating controller 10 is connected to the steering wheel 21, the remote controller 22, and the joystick 23 by wire or wirelessly.

The watercraft manipulating controller 10 receives the steering signal from the sensor 210. The watercraft manipulating controller 10 receives throttle signals from the sensors 221 and 222. The watercraft manipulating controller 10 receives the joystick signal from the sensor 230. The watercraft manipulating controller 10 outputs command signals to the first and second engine controllers 9*a* and 9*b* based on the signals from the sensors 210, 221, 222, and 230.

For example, the watercraft manipulating controller 10 outputs a command signal to the shift actuator 7*a* according to the operation direction of the first throttle lever 22*a*. As a result, the left propulsion device 1*a* is switched between forward and reverse. The watercraft manipulating controller 10 outputs a throttle command to the engine 2*a* according to the operation amount of the first throttle lever 22*a*. The first engine controller 9*a* controls the engine speed of the left propulsion device 1*a* according to the throttle command.

The watercraft manipulating controller 10 outputs a command signal to the shift actuator 7*b* according to the operation direction of the second throttle lever 22*b*. As a result, the forward movement and the reverse movement of the right propulsion device 1*b* are switched. The watercraft manipulating controller 10 outputs a throttle command to the engine 2*b* according to the operation amount of the second throttle lever 22*b*. The second engine controller 9*b* controls the engine speed of the right propulsion device 1*b* according to the throttle command.

The watercraft manipulating controller 10 outputs a command signal to the steering actuators 8*a* and 8*b* according to the operation direction and the operation amount of the steering wheel 21. When the steering wheel 21 is operated leftward from the neutral position, the watercraft manipulating controller 10 controls the steering actuators 8*a* and 8*b* so that the left propulsion device 1*a* and the right propulsion device 1*b* rotate rightward. Thus, the watercraft 100 turns to the left.

When the steering wheel 21 is operated rightward from the neutral position, the watercraft manipulating controller 10 controls the steering actuators 8*a* and 8*b* so that the left propulsion device 1*a* and the right propulsion device 1*b* rotate leftward. Thus, the watercraft 100 turns to the right. Further, the watercraft manipulating controller 10 controls the steering angles of the left propulsion device 1*a* and the right propulsion device 1*b* according to the operation amount of the steering wheel 21.

The watercraft manipulating controller 10 outputs command signals to the engines 2*a* and 2*b*, the shift actuators 7*a* and 7*b*, and the steering actuators 8*a* and 8*b* according to the tilt direction and the tilt amount of the joystick 23. The watercraft manipulating controller 10 controls the engines 2*a* and 2*b*, the shift actuators 7*a* and 7*b*, and the steering actuator 8*a* and 8*b* so that the watercraft 100 moves parallel or substantially parallel to a direction corresponding to the tilt direction of the joystick 23 at a speed corresponding to the tilt amount.

When the joystick 23 is tilted forward, the watercraft manipulating controller 10 moves the watercraft 100 forward (forward movement mode). When the joystick 23 is tilted backward, the watercraft manipulating controller 10 moves the watercraft 100 rearward (rear movement mode).

Figure 6:
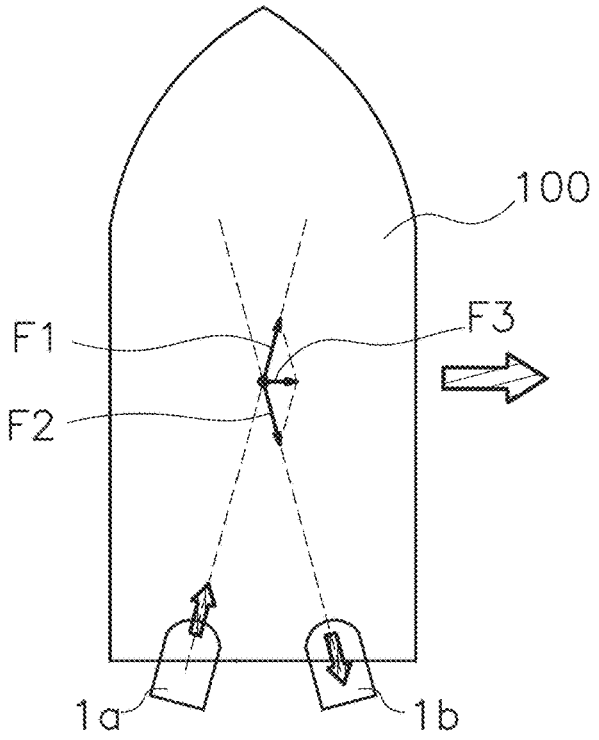
FIG. 6 is a schematic diagram showing control in a lateral movement mode.
Figure 6:
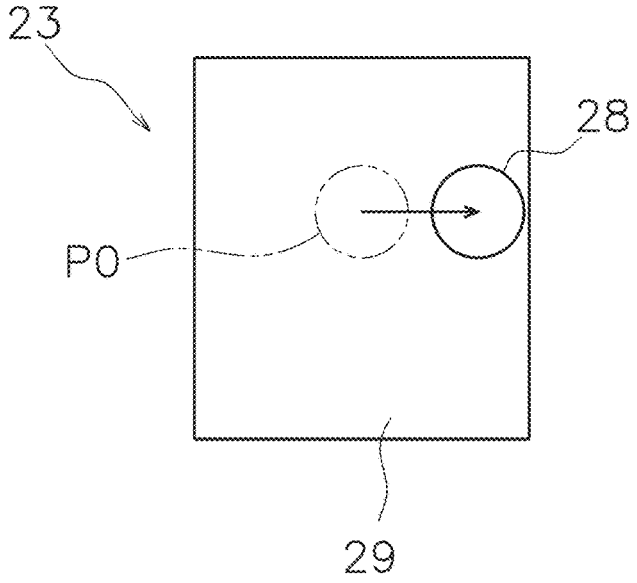

When the joystick 23 is tilted leftward or rightward, the watercraft manipulating controller 10 laterally moves the watercraft 100 leftward or rightward (lateral movement mode). For example, as illustrated in FIG. 6, when the joystick 23 is tilted to the right, the watercraft manipulating controller 10 controls the thrusts and the steering angles of the propulsion devices 1*a* and 1*b* so that a resultant force F3 between the thrust F1 of the left propulsion device 1*a* and the thrust F2 of the right propulsion device 1*b* is directed rightward of the watercraft 100. Although illustration thereof is omitted, when the joystick 23 is tilted to the left, the watercraft manipulating controller 10 controls the thrusts and the steering angles of the propulsion devices 1*a* and 1*b* so that the resultant force F3 between the thrust F1 of the left propulsion device 1*a* and the thrust F2 of the right propulsion device 1*b* is directed leftward of the watercraft 100.

The watercraft manipulating controller 10 controls the engines 2*a* and 2*b*, the shift actuators 7*a* and 7*b*, and the steering actuators 8*a* and 8*a* so that the watercraft 100 pivots in a direction corresponding to the twist direction of the joystick 23 at a speed corresponding to the twist amount (bow pivoting mode). For example, the watercraft manipulating controller 10 generates a forward thrust on one of the left propulsion device 1*a* and the right propulsion device 1*b*, and generates a reverse thrust on the other of the left propulsion device 1*a* and the right propulsion device 1*b* to pivot the watercraft 100.

The system includes a position sensor 25. The position sensor 25 detects a position of the watercraft 100. The position sensor 25 includes, for example, a GNSS (Global Navigation Satellite System) receiver such as a GPS (Global Positioning System). However, the position sensor 25 may be a type of sensor other than the GNSS receiver. The position sensor 25 outputs a signal indicative of the position of the watercraft 100. The watercraft manipulating controller 10 is communicatively connected to the position sensor 25. The watercraft manipulating controller 10 acquires the position of the watercraft 100 based on the signal from the position sensor 25. Further, the watercraft manipulating controller 10 acquires the speed of the watercraft 100 based on the signal from the position sensor 25. The system may include a separate sensor to detect the speed of the watercraft 100.

The system includes an orientation sensor 26. The orientation sensor 26 detects a heading of the watercraft 100. The orientation sensor 26 includes, for example, an IMU (inertial measurement unit). However, the orientation sensor 26 may be a type of sensor other than the IMU. The watercraft manipulating controller 10 is communicatively connected to the orientation sensor 26. The watercraft manipulating controller 10 acquires the heading of the watercraft 100 based on the signal from the orientation sensor 26.

The system includes a switch 31. As illustrated in FIG. 5, the switch 31 is located on the grip 28. The switch 31 is located on an upper portion of the grip 28, for example. For example, the switch 31 is located on a top surface of the grip 28. The switch 31 is, for example, a push button switch. However, the switch 31 may be another type of switch such as a slide switch or a rotary switch.

The joystick 23 returns to the neutral position and the central position when not operated by the operator. When the joystick 23 is in the neutral position and the central position, the watercraft manipulating controller 10 returns the shift state of the propulsion devices to the neutral position and the steering angle to the predetermined angle. When the switch 31 is operated, the watercraft manipulating controller 10 enters a holding mode. In the holding mode, the watercraft manipulating controller 10 stores a control state of the propulsion devices 1*a* and 1*b* according to the operation of the joystick 23 at the time the switch 31 is operated.

When the switch 31 is operated, even if the joystick 23 is returned to the neutral position and the central position, the watercraft manipulating controller 10 maintains the propulsion devices 1*a* and 1*b* in the stored control state. The control state includes at least one of a throttle command to the propulsion devices 1*a* and 1*b*, a watercraft speed, a moving direction of the watercraft, a steering angle of the propulsion devices 1*a* and 1*b*, and a shift operation. The watercraft manipulating controller 10 may store the control state described above by storing the joystick signal when the switch 31 is operated.

For example, when the operator tilts the joystick 23 to the right or left, the watercraft manipulating controller 10 controls the propulsion devices 1*a* and 1*b* so that the watercraft 100 moves laterally according to the tilt direction of the joystick 23. When the operator operates the switch 31 in this state, the watercraft manipulating controller 10 enters the holding mode and stores the control state of the propulsion devices 1*a* and 1*b* when the switch 31 is operated. Alternatively, the watercraft manipulating controller 10 may store the tilt direction and the tilt amount of the joystick 23 when the switch 31 is operated.

In the holding mode, even if the operator releases the joystick 23, the watercraft manipulating controller 10 controls the engines 2*a* and 2*b*, the shift actuators 7*a* and 7*b*, and the steering actuators 8*a* and 8*b* so that the control state is maintained. Thus, the lateral movement of the watercraft 100 is maintained even if the operator does not operate the joystick 23.

Figure 7:
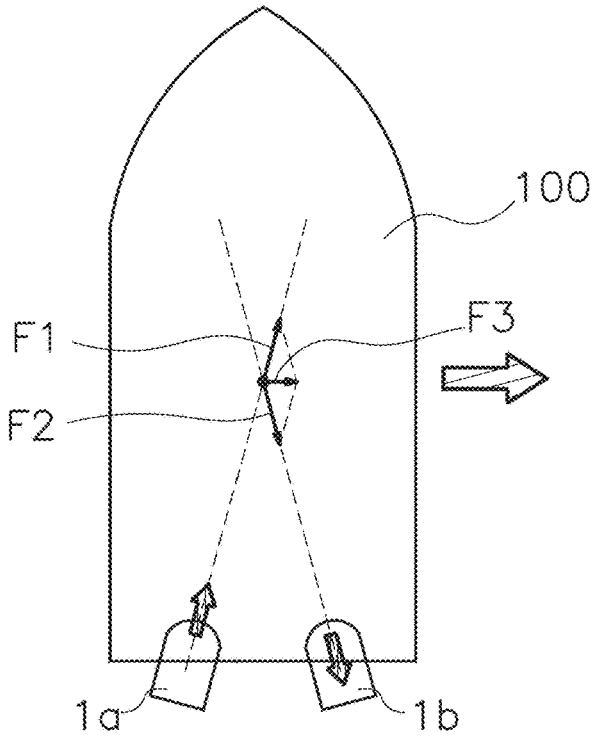
FIG. 7 is a schematic diagram showing control in a holding mode.
Figure 7:
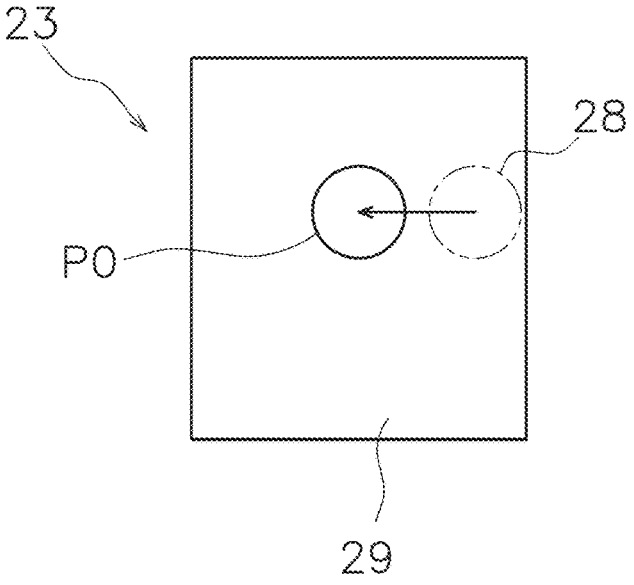

For example, in the example illustrated in FIG. 6, when the operator tilts the joystick 23 to the right, the watercraft manipulating controller 10 controls the shift operations, the throttle commands, and the steering angles of the propulsion devices 1*a* and 1*b* so that the resultant force F3 between the thrust F1 of the left propulsion device 1*a* and the thrust F2 of the right propulsion device 1*b* is directed rightward of the watercraft 100. As a result, the watercraft 100 laterally moves to the right. At this time, when the operator operates the switch 31, the watercraft manipulating controller 10 enters the holding mode and stores the shift operation, the throttle command, and the steering angle of the propulsion devices 1*a* and 1*b*. As a result, as illustrated in FIG. 7, even when the joystick 23 returns to the neutral position P0, the watercraft manipulating controller 10 maintains the shift operation, the throttle command, and the steering angle of the propulsion devices 1*a* and 1*b* at the time the switch 31 is operated. Thus, even if the joystick 23 returns to the neutral position P0, the lateral movement of the watercraft 100 is maintained.

A control when the operator tilts the joystick 23 to the left is the same as the above control except that the left and right are reversed. Also, when the operator tilts the joystick 23 forward or backward, the watercraft manipulating controller 10 stores the control state when the switch 31 is operated, and controls the propulsion devices 1*a* and 1*b* to be maintained in that control state.

The watercraft manipulating controller 10 may store the moving direction of the watercraft 100 when the switch 31 is operated. The watercraft manipulating controller 10 may control the propulsion devices 1*a* and 1*b* so that the watercraft 100 moves in the moving direction when the switch 31 is operated even when the joystick 23 returns to the neutral position P0. The watercraft manipulating controller 10 may store the heading of the watercraft 100 when the switch 31 is operated. Even when the joystick 23 returns to the neutral position P0, the watercraft manipulating controller 10 may control the propulsion devices 1*a* and 1*b* so that the watercraft 100 faces the direction of the heading when the switch 31 is operated. The watercraft manipulating controller 10 may store the speed of the watercraft 100 when the switch 31 is operated. The watercraft manipulating controller 10 may control the propulsion devices 1*a* and 1*b* so that the watercraft 100 moves at the speed when the switch 31 is operated even when the joystick 23 returns to the neutral position P0.

In the holding mode, the watercraft manipulating controller 10 may store the control state of the propulsion devices 1*a* and 1*b* according to the twisting operation of the joystick 23 when the switch 31 is operated. In the holding mode, even if the joystick 23 is returned to the central position, the watercraft manipulating controller 10 may maintain the propulsion devices 1*a* and 1*b* in the control state when the switch 31 is operated.

For example, when the operator twists the joystick 23 clockwise or counterclockwise, the watercraft manipulating controller 10 controls the throttle commands, the steering angles, and the shift operations of the propulsion devices 1*a* and 1*b* so that the watercraft 100 pivots according to the twist direction of the joystick 23. In this state, when the operator operates the switch 31, the watercraft manipulating controller 10 enters the holding mode and stores the throttle commands, the steering angles, and the shift operations of the propulsion devices 1*a* and 1*b* when the switch 31 is operated. Alternatively, the watercraft manipulating controller 10 may store the twist direction and the twist amount of the joystick 23 when the switch 31 is operated. In the holding mode, even if the joystick 23 returns to the neutral position P0, the watercraft manipulating controller 10 controls the engines 2*a* and 2*b*, the shift actuators 7*a* and 7*b*, and the steering actuators 8*a* and 8*b* to maintain the control state. As a result, the pivoting of the watercraft 100 is maintained even if the operator does not operate the joystick 23.

The watercraft manipulating controller 10 cancels the holding mode by operating the joystick 23 from the neutral position during the holding mode. Alternatively, the watercraft manipulating controller 10 may cancel the holding mode by operating the switch 31 during the holding mode. When the holding mode is canceled, the propulsion devices 1*a* and 1*b* are released from the control state described above.

In the system according to the preferred embodiments described above, by operating the switch 31 when an operator sets the watercraft to a desired state by operating the joystick 23, the watercraft manipulating controller 10 controls the propulsion devices 1*a* and 1*b* to maintain the desired state. As a result, the operational burden on the operator is reduced.

Although preferred embodiments of the present invention have been described above, the present invention is not limited to the above preferred embodiments, and various modifications can be made without departing from the scope of the invention. For example, the number of propulsion devices is not limited to two. The number of propulsion devices may be one or more than two. Some of the components of the propulsion devices 1*a* and 1*b* described above may be changed or omitted. The propulsion device is not limited to the outboard motor and may be another type of device such as a water jet propulsion device. Parts or portions of the control described above may be changed or omitted. For example, the control state stored in the holding mode is not limited to the one described above and may be changed. In the holding mode, the control state described above may be maintained by feedback control.

Figure 8:
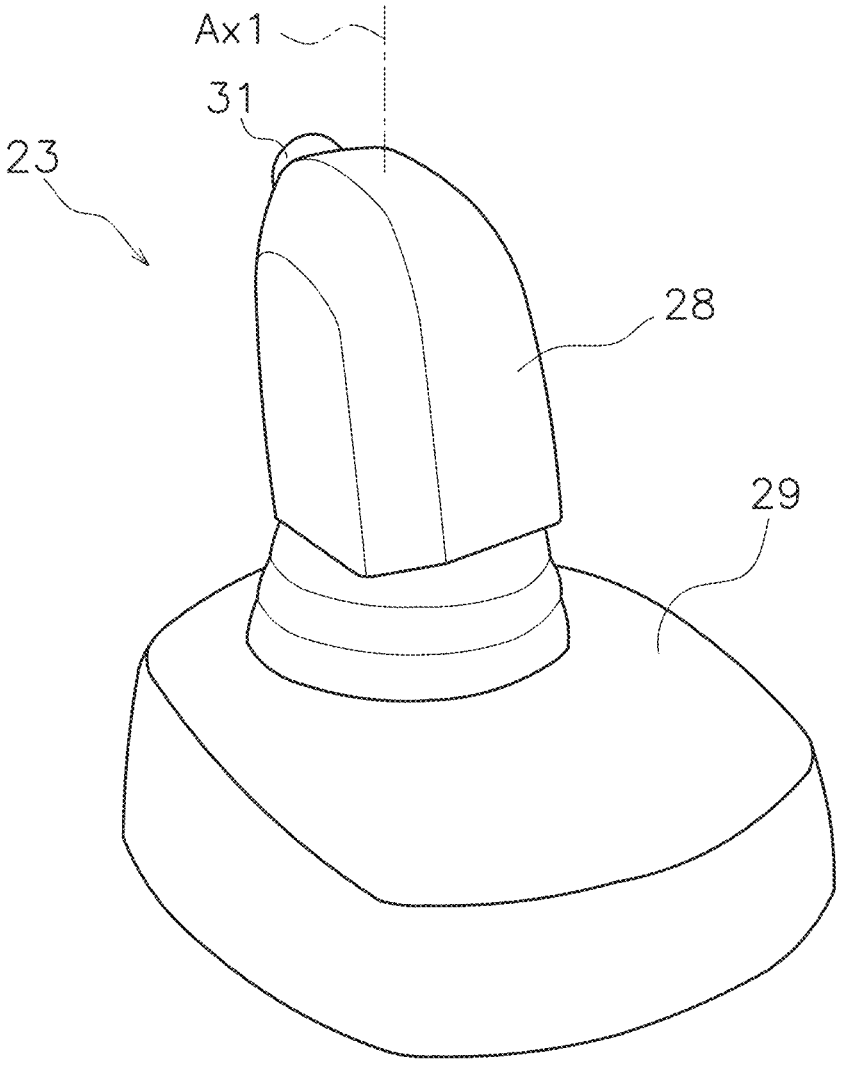
FIG. 8 is a diagram showing a first modification of an arrangement of a switch.
Figure 9:
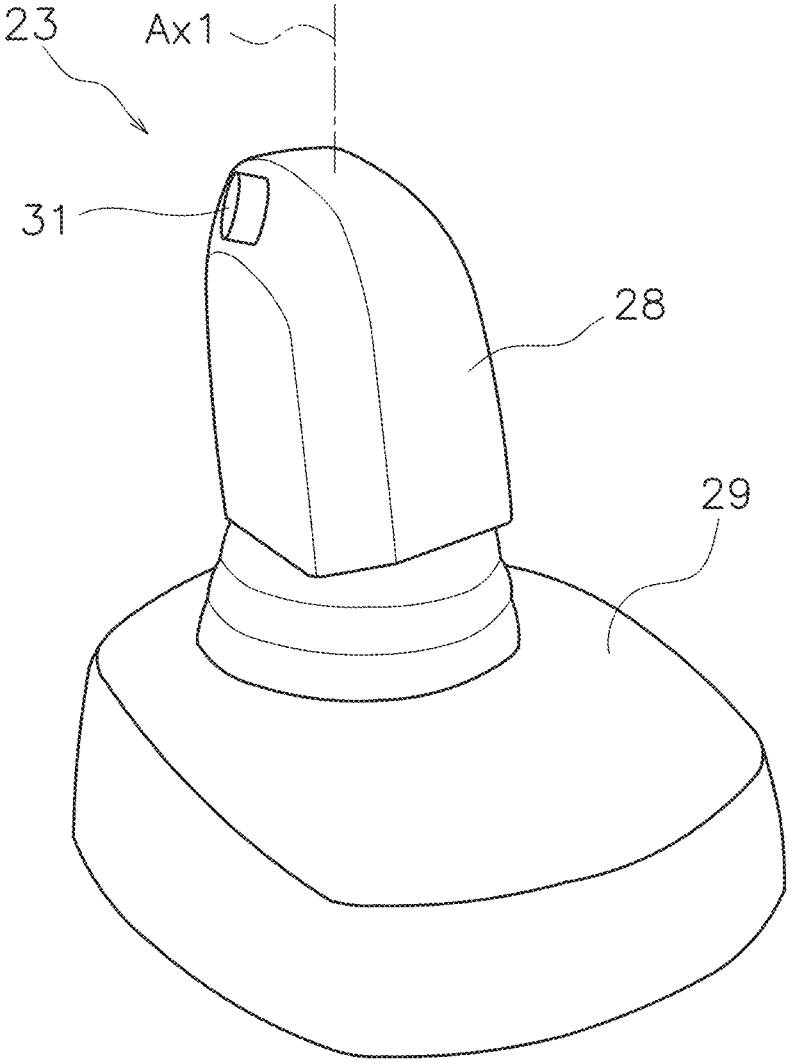
FIG. 9 is a diagram showing a second modification of an arrangement of the switch.
Figure 10:
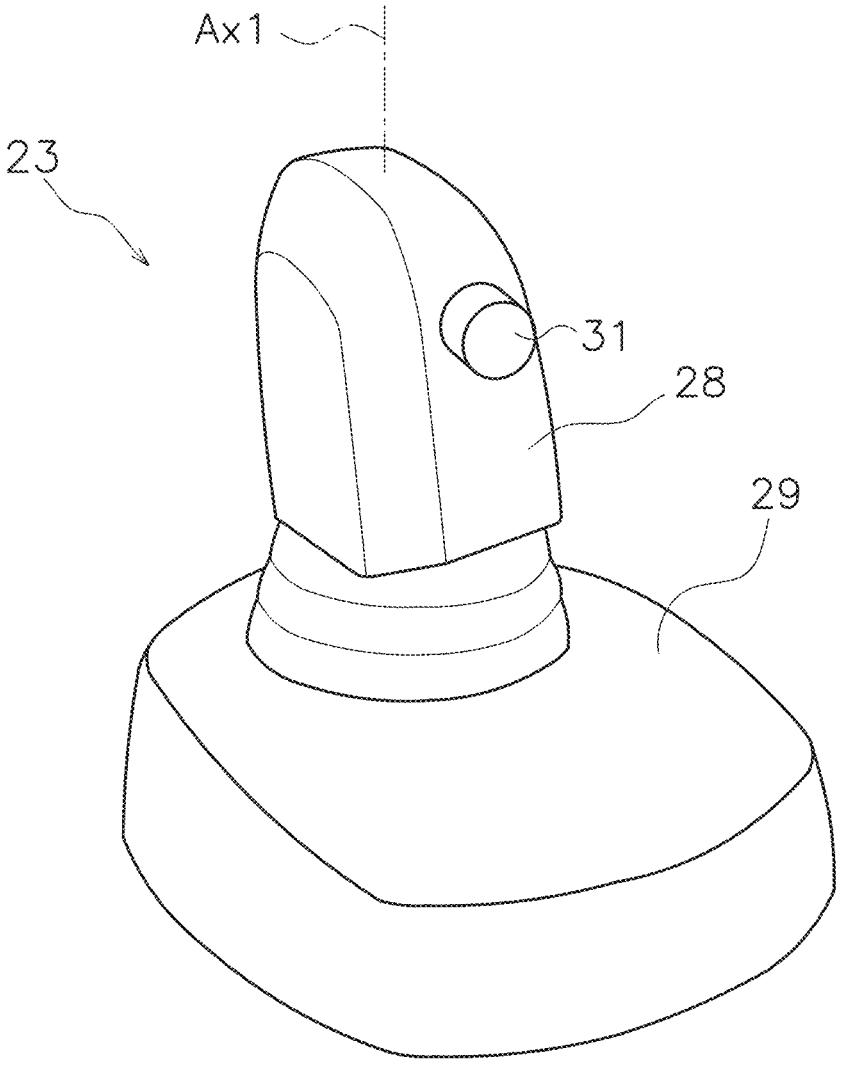
FIG. 10 is a diagram showing a third modification of an arrangement of the switch.
Figure 11:
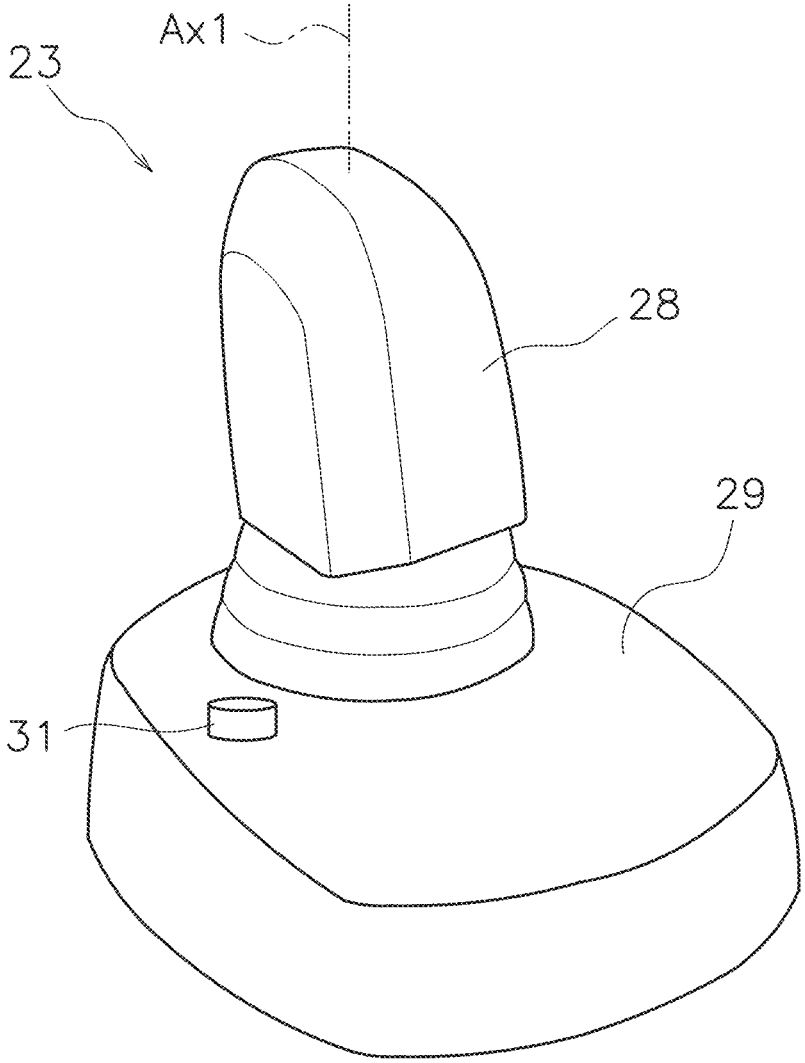
FIG. 11 is a diagram showing a fourth modification of an arrangement of the switch.
Figure 12:
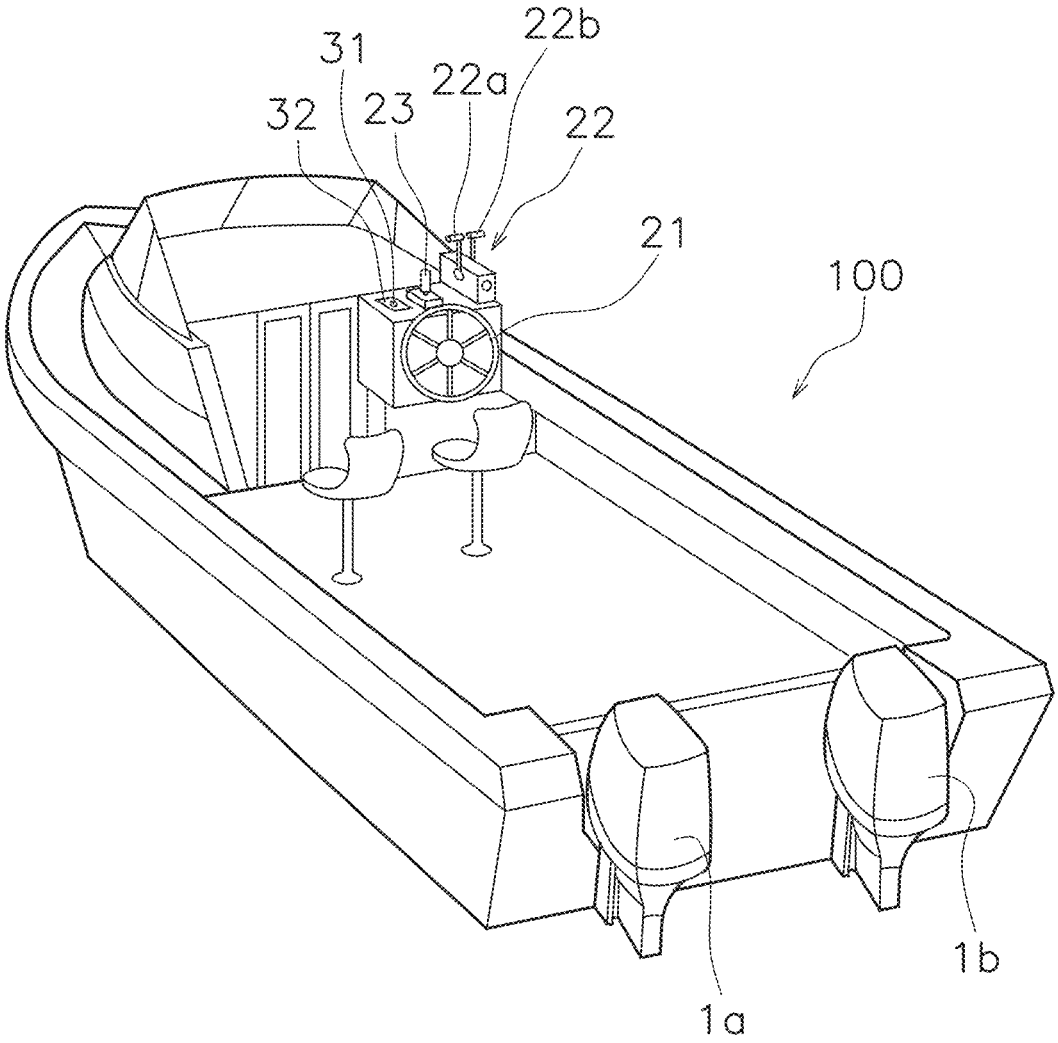
FIG. 12 is a diagram showing a fifth modification of an arrangement of the switch.

The arrangement of the switch 31 is not limited to that of the above-described preferred embodiments, and may be changed. For example, as illustrated in FIG. 8, the switch 31 may be located on the front surface of the grip 28. Alternatively, as illustrated in FIG. 9, the switch 31 may be located on the side surface of the grip 28. Alternatively, as illustrated in FIG. 10, the switch 31 may be located on the back surface of the grip 28. Alternatively, as illustrated in FIG. 11, the switch 31 may be located on the base 29. Alternatively, as illustrated in FIG. 12, the switch 31 may be located on the operation panel 32 that is separate from the joystick 23. The switch 31 is not limited to a hardware key and may be a software key displayed on a touch screen.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a propulsion device mounted on a watercraft, the system comprising:

a joystick tiltable in at least a front-rear direction and a left-right direction from a neutral position;

a switch; and a controller in communication with the joystick and the switch, the controller being configured or programmed to:

control a shift operation of the propulsion device between forward, neutral, and reverse, and steering of the propulsion device according to a tilt operation of the joystick;

store a control state of the propulsion device according to the tilt operation of the joystick when the switch is operated; and maintain the propulsion device in the control state even when the joystick is returned to the neutral position.

2. The system according to claim 1, wherein the controller is configured or programmed to release the propulsion device from the control state by operating the joystick from the neutral position.

3. The system according to claim 1, wherein the controller is configured or programmed to release the propulsion device from the control state by operating the switch.

4. The system according to claim 1, wherein the control state includes a throttle command to the propulsion device.

5. The system according to claim 1, wherein the control state includes a speed of the watercraft.

6. The system according to claim 1, wherein the control state includes a moving direction of the watercraft.

7. The system according to claim 1, wherein the control state includes a steering angle of the propulsion device.

8. The system according to claim 1, wherein the control state includes the shift operation.

9. The system according to claim 1, wherein the switch is located on the joystick.

10. The system according to claim 9, wherein the joystick includes a grip and a base that tiltably supports the grip; and the switch is located on the grip.

11. The system according to claim 1, wherein the joystick is twistable; and the controller is configured or programmed to:

control the steering of the propulsion device according to a twisting operation of the joystick;

store the control state of the propulsion device according to the twisting operation of the joystick when the switch is operated; and maintain the propulsion device in the control state even when the joystick is returned to the neutral position.

12. A method for controlling a propulsion device mounted on a watercraft, the method comprising:

receiving a signal from a joystick that is tiltable in at least a front-rear direction and a left-right direction from a neutral position;

controlling a shift operation of the propulsion device between forward and reverse, and steering the propulsion device according to a tilt operation of the joystick in the front-rear direction;

receiving a signal from a switch;

storing a control state of the propulsion device according to the tilt operation of the joystick when the switch is operated; and maintaining the propulsion device in the control state even when the joystick is returned to the neutral position.

13. The method according to claim 12, further comprising:

releasing the propulsion device from the control state by operating the joystick from the neutral position.

14. The method according to claim 12 further comprising:

releasing the propulsion device from the control state by operating the switch.

15. The method according to claim 12, wherein the control state includes a throttle command to the propulsion device.

16. The method according to claim 12, wherein the control state includes a speed of the watercraft.

17. The method according to claim 12, wherein the control state includes a moving direction of the watercraft.

18. The method according to claim 12, wherein the control state includes a steering angle of the propulsion device.

19. The method according to claim 12, wherein the control state includes the shift operation.

20. The method according to claim 12, wherein the joystick is twistable, and the method further comprises:

controlling the steering of the propulsion device according to a twisting operation of the joystick;

storing the control state of the propulsion device according to the twisting operation of the joystick when the switch is operated; and maintaining the propulsion device in the control state even when the joystick is returned to the neutral position.

* * * * *